3/20/84 4,438,014

United States Patent [19]

Scott

[11] 4,438,014

[45] Mar. 20, 1984

[54] NONIONIC SURFACTANTS FOR AUTOMATIC DISHWASHER DETERGENTS

[75] Inventor: Robert J. Scott, New City, N.Y.

[73] Assignee: Union Carbide Corporation, Danbury, Conn.

[21] Appl. No.: 349,174

[22] Filed: Feb. 16, 1982

[51] Int. Cl.[3] ..... C11D 1/66

[52] U.S. Cl. ..... 252/174.21; 252/DIG. 1; 252/95; 252/99; 252/135

[58] Field of Search ..... 252/89.1, 135, 99, 95, 252/174.21, DIG. 14, DIG. 1

[56] References Cited

U.S. PATENT DOCUMENTS

| | | | |
|---|---|---|---|
| 3,314,891 | 4/1967 | Schmolka et al. | 252/89 |
| 3,549,539 | 12/1970 | Mallows et al. | 252/99 |
| 3,770,701 | 11/1973 | Cenker et al. | 260/65 B |
| 3,936,386 | 2/1976 | Corliss et al. | 252/99 |
| 4,136,045 | 1/1979 | Gault et al. | 252/135 |
| 4,169,806 | 10/1979 | Davis et al. | 252/99 |
| 4,188,305 | 2/1980 | Halas | 252/95 |
| 4,199,467 | 4/1980 | Novosel et al. | 252/95 |
| 4,199,468 | 4/1980 | Barford et al. | 252/103 |
| 4,226,736 | 10/1980 | Bush et al. | 252/135 |
| 4,272,394 | 6/1981 | Kaneko | 252/99 |
| 4,306,987 | 12/1981 | Kaneko | 252/99 |
| 4,340,382 | 7/1982 | Morlino et al. | 252/8.9 |

FOREIGN PATENT DOCUMENTS 19173 5/1980 European Pat. Off. .

*Primary Examiner*—John E. Kittle
*Assistant Examiner*—Hoa Van Le
*Attorney, Agent, or Firm*—Jean B. Mauro

[57] ABSTRACT

Nonionic surfactants, for automatic dishwasher detergents, are provided having specific alkoxylates bonded to block oxypropylene and oxyethylene/oxypropylene mixtures. These surfactants provide enhanced low-foaming and wetting, and compatibility with active chlorine compounds.

1 Claim, No Drawings

NONIONIC SURFACTANTS FOR AUTOMATIC DISHWASHER DETERGENTS

BACKGROUND OF THE INVENTION

1. Field of the Invention

This invention relates to low-foaming nonionic surfactants and, more particularly, to low-foaming nonionic surfactant compounds which are especially suitable for use in automatic dishwashers and to automatic dishwashing detergent compositions which contain such surfactant compounds.

2. Description of the Prior Art

Detergent compositions containing, in combination, alkaline salts such as sodium silicate and sodium carbonate, an alkaline polyphosphate such as sodium tripolyphosphate, a low-foaming, chlorine-compatible nonionic surfactant, and a chlorine containing compound that provides a hydrochlorite ion in solution are well known and have particular utility in machine dishwashing.

There are many different views on how dishwashing detergents function, but there seems to be general agreement on several points, to wit: (1) the main cleaning is done by the alkaline salts whether by emulsification, saponification, sequestering hard water ions and/or other mechanisms; (2) the active chlorine compound is aimed principally at protein soil but also serves as a destainer and germicide; (3) solubilized protein soil is a main cause of foaming problems; and (4) the surfactant provides optimum cleaning and good spotting and filming results while also providing defoaming power in the presence of foam producing food soil, but the use of auxiliary foam depressants is generally preferred to achieve optimum foam suppressing characteristics. Thus, while dishwasher detergents may clean by a number of processes, the combination of requirements for surfactants that are employed in such detergent compositions are well established. The surfactant must be low foaming and be capable of defoaming food soils; it must have a low cloud point (generally less than about 30° C.) so that it can function as a foam suppressor by separating from solution under hot water temperature (e.g. about 60° C.) but at the same time be sufficiently soluble in the wash liquor to provide wetting; it must be compatible with active chlorine and not markedly decompose those chlorinated compounds used in detergent compositions; and it must have good wetting characteristics to give good spotting and filming results.

Automatic dishwater detergents containing nonionic surfactants of alkoxylated alcohols having block oxypropylene groups and random mixtures of oxyethylene/oxypropylene groups have been disclosed. U.S. Pat. No. 4,272,394 (Kaneko I) and U.S. Pat. No. 4,306,987 (Kaneko II) describe a wide variety of alkoxylated alcohol surfactants including those containing an oxyalkylene block, oxyethylene/oxyalkylene mixture, oxyalkylene block structure. European Patent No. 19, 173 (BASF) discloses a $C_9/C_{11}$ oxyalkylated alcohol having a block oxypropylene, oxyethylene/oxypropylene mixture, having oxyalkylene molar ratios of 2:2 to 3:2 respectively. This latter patent discloses that these structures are derived from West German Printed Publication No. 1, 645,011, which corresponds with U.S. Pat. No. 3,770,701 (Cenker, et al.). None of these patents, however, discloses a nonionic surfactant having the particular structure defined by the claims of the present invention. At their best, the two Kaneko patents describe nonionic surfactants having additional block oxyalkylene groups. The latter two patents describe nonionic surfactant structures having different oxyalkylated alcohols and oxyalkylene ratios from those claimed in the present invention.

Other nonionic surfactants have been used commercially or suggested as meeting these requirements such as, for example, the polyethoxylated octylphenols and polyoxyalkylene glycols disclosed in U.S. Pat. No. 3,936,386 (Corliss et al.); the particular $C_{17}$–$C_{19}$ polyethoxylates disclosed in U.S. Pat. No. 4,188,305 (Halas) and U.S. Pat. No. 4,199,468 (Barford et al.); the mixture of an ethylene oxide adduct of nonylphenol or a secondary alcohol and a block oxyethylene/oxypropylene condensate disclosed in U.S. Pat. No. 3,549,539 (Mallows); and the variety of nonionic surfactants disclosed in U.S. Pat. No. 3,314,891 (Schmolka et al.), U.S. Pat. No. 4,136,045 (Gault et al.), and U.S. Pat. No. 4,169,806 (Davis et al.).

While some of these surfactants have received commercial acceptance in various mechanical dishwasher detergent compositions, it would be desirable if a surfactant was developed which exhibited even further improvements in foam suppressing characteristics so as to minimize or eliminate the need for an auxiliary foam suppressing agent, and/or in wetting properties so as to enhance spotting and filming characteristics.

SUMMARY OF INVENTION

In accordance with the present invention there is provided a nonionic surfactant derived by condensing specific monohydroxylic primary alcohols with a specific amount of propylene oxide and ethylene oxide to prepare a condensation product having an oxypropylene block and oxyethylene/oxypropylene random molecular configuration. More specifically there is provided in accordance with the invention a low-foaming nonionic surfactant prepared by first reacting a $C_8$ primary alcohol, either branched or straight chain, with more than 7 to about 10 moles, and preferably from about 8 to 9 moles of propylene oxide to form a block structure and then reacting the block adduct with a random mixture of ethylene oxide and propylene oxide in a molar ratio of ethylene oxide to propylene oxide of from 2:1 to about 5:1, and preferably about 3:1, in an amount sufficient to obtain a surfactant having a cloud point of from about 20° C. to about 30° C. The surfactant composition of this invention may be represented by the formula:

$$R—O—A_x—B—H$$

wherein R is an acyclic alkyl group having 8 carbon atoms; A is an oxypropylene group; x is an integer greater than 7 to about 10, and B is a random mixture of oxyethylene groups and oxypropylene groups in the molar ratio of about 2:1 to about 5:1 with the proviso that the total number of moles of the mixture of oxyalkylene groups will provide a surfactant having a cloud point of from about 20° C. to about 30° C.

It has been discovered that the nonionic surfactants of the invention are compatible with active chlorine, exhibit good low-foaming and foam suppressing characteristics which minimize the need for using auxiliary foam suppressors in compositions such as mechanical dishwasher detergents, and also provide enhanced wetting characteristics compared to nonionic surfactants employed commercially in dishwasher detergent compositions, thus giving improved spotting and filming results.

Low-foaming nonionic surfactant compositions that exhibit a unique combination of low-foam and wetting properties are prepared by condensing alcohols having from 7 to 11 carbon atoms with particular proportions of propylene oxide and ethylene oxide so as to form a particular oxypropylene block and oxyethylene-oxypropylene random molecular structure are disclosed in copending patent application Ser. No. 206,145, filed Nov. 12, 1980 which is incorporated herein by reference. These surfactants have the formula:

$$R'—O—A'_x—B'—H$$

wherein R' is a primary alkyl group having seven to eleven carbon atoms; A' is an oxypropylene group; x is an integer of from 2 to about 15 such that the sum of carbon atoms in said alkyl group and x is from 12 to about 22; and B' is a random mixture of oxyethylene and oxypropylene groups with the molar ratio of oxyethylene to oxypropylene being from 1:1 to about 5:1 such that the total molar ratio of oxyethylene to oxypropylene in A' and B' being from 0.2:1 to 1.5:1.

There is also provided in accordance with the present invention automatic dishwasher detergent compositions comprising:

(a) from about 10 weight percent to about 90 weight percent, preferably about 20 weight percent to about 70 weight percent, of a detergency builder (b) from about 0.5 weight percent to about 10 weight percent, preferably about 1 weight percent to about 3 weight percent, of an active chlorine containing compound; and (c) from about 1 weight percent to about 15 weight percent, preferably about 2 weight percent to about 10 weight percent, of above-described nonionic surfactant.

A method is also provided for washing dishes in an automatic dishwasher by providing a nonionic surfactant having the formula:

$$R—O—A_xB—H$$

wherein R is an acyclic alkyl group having eight carbon atoms; A is an oxypropylene group; x is an integer of from 7 to about 10; and B is a random mixture of oxyethylene and oxypropylene groups with the molar ratio of oxyethylene to oxypropylene groups being from about 2:1 to about 5:1.

DETAILED DESCRIPTION OF THE INVENTION

The low-foaming, chlorine compatible nonionic surfactants of the present invention having superior wetting characteristics and enhanced foam suppressing power in the presence of foam-producing food soils are condensate products of a particular monohydric aliphatic alcohol that have a particular block-random oxyalkylene molecular structure. The nonionic surfactant compositions of this invention may be represented by the formula:

$$R—O—A_x—B—H$$

wherein R is an acyclic alkyl group having 8 carbon atoms, A is an oxypropylene group, x is an integer greater than 7 to about 10 and preferably 8 or 9, and B is a random mixture of oxyethylene and oxypropylene groups with the molar ratio of oxyethylene to oxypropylene groups being from about 2:1 to about 5:1, and preferably about 3:1, and with the total number of moles of said random mixture of alkylene oxide groups being such that the cloud point of said nonionic surfactant is in the range from about 20° C. to about 30° C. (ASTM D 2024-65 in a 1 percent water solution). The R—O in the foregoing formula may also be defined as the residue of the alcohol employed in the condensation reaction to produce the condensate, i.e., a primary alcohol with the hydrogen in the OH radical removed.

The nonionic surfactant of this invention can be obtained by reacting a primary aliphatic monohydric alcohol, either straight or branched chain, having 8 carbon atoms, with more than 7 to about 10, and preferably about 8 to 9, moles of propylene oxide to form a block molecular structure and then reacting the block adduct with a sufficient amount of a random mixture of ethylene oxide and propylene oxide in a molar ratio of oxyethylene to oxypropylene of from about 2:1 to about 5:1 to prepare surfactants having a cloud point in the range from about 20° C. to about 30° C. It has been surprisingly and unexpectedly found that only those surfactant compositions prepared from primary monohydric alcohols having 8 carbon atoms to form condensates with particular amounts of propylene oxide and ethylene oxide having the block-random molecular structure herein described, achieve suitable chlorine compatability along with a desired combination and balance of low-foaming, foam suppressing, and superior wetting properties.

Alcohols which may be employed in preparing the surfactants are primary, straight- and branched-chain aliphatic monohydric alcohols which contain 8 carbon atoms. Exemplary suitable alcohols are 2-ethylhexanol and n-octanol and mixtures thereof.

The surfactants of the present invention are prepared by condensing an alcohol as described herein with propylene oxide and then a mixture of ethylene oxide and propylene oxide in two distinct steps. In the first step, propylene oxide is added to the alcohol and the condensation reaction is carried out generally in the presence of an alkaline catalyst. Catalysts which may be employed include sodium hydroxide, potassium hydroxide, sodium acetate and preferably an alkali metal alcoholate of the alcohol. Any other type of catalysts commonly used for alkylene oxide addition reactions with reactive hydrogen compounds may also be employed. After the condensation reaction in the first step is completed, a mixture of ethylene oxide and propylene oxide is added to the reaction mixture from the first step until a product having the desired cloud point is obtained. No additional catalyst is usually required to carry out the second step of the reaction. The condensation reaction in both the first and second steps is preferably carried out at elevated temperatures and pressures. After the condensation reaction is completed, the catalyst is removed from the reaction mixture by any known procedure such as neutralization and filtration or ion exchange.

The nonionic surfactants herein described exhibit the combination and balance of low-foaming, foam suppressing, superior wetting and chlorine compatability required for automatic dishwasher detergent compositions and, in fact, are useful in preparing such compositions which exhibit superior spotting and filming properties.

The automatic dishwashing detergent compositions provided in accordance with this invention comprise;

1. from about 10 weight percent to about 90 weight percent, and preferably from about 20 weight percent to about 70 weight percent of the composition, of a detergency builder;

2. from about 0.5 weight percent to about 10 weight percent, and preferably from about 1 weight percent to about 3 weight percent of the composition, of a chlorine-containing compound; and 3. from about 1 weight percent to about 15 weight percent, and preferably from about 2 weight percent to about 10 weight percent of the composition, of the herein described low-foaming nonionic surfactant.

The detergency builder can be any of the known detergent builders. Suitable builders include trisodium phosphate, tetrasodium pyrophosphate, sodium acid pyrophosphate, sodium tripolyphosphate, sodium hexametaphosphate, sodium silicates having $SiO_2$:$Na_2O$ ratios of from about 1:1 to about 3.6:1, sodium carbonate, sodium hydroxide, sodium citrate, borax, sodium ethylene diaminetetraacetate, sodium nitrilotriacetate, sodium carboxy/methyloxysuccinate, and mixtures thereof. Although the sodium salts are the most commonly used, potassium, ammonium, and substituted ammonium (e.g. methyl, monoethanol, diethanol and triethanol ammonium) salts can be substituted. Other suitable builder salts are well known and disclosed in the prior art. Compositions of the invention will contain from about 10 weight percent to about 90 weight percent, and preferably from about 20 weight percent to about 70 weight percent of such builders.

Chlorine-containing compounds suitable for use in compositions of the invention are chlorine bleach compounds which contain chlorine in active form. Such compounds are often characterized as hypochlorite compounds, which are well known as a class. Exemplary suitable chlorine-containing compounds are chlorinated trisodium phosphate, sodium and potassium dichlorocyanurates; dichlorocyanuric acid; 1,3-dichloro-5,5-dimethyl hydantoin, N,N'-dichlorobenzoylene urea; paratoluene sulfondichloroamide; trichloromelamine; N-chloroammeline; N-chlorosuccamide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Compositions of the invention should contain from about 0.5 weight percent to about 10 weight percent, and preferably from about 1 weight percent to about 3 weight percent, of such chlorine-containing compounds. Such compounds should have a source of available chlorine in an amount sufficient to provide available chlorine equal to about 0.5 weight percent to about 3 weight percent by weight of the composition.

The nonionic surfactant component of the automatic dishwashing detergent compositions of the invention are the low-foaming nonionic surfactants of the invention which are the condensate products of $C_8$ monohydric aliphatic alcohols having a particular block-random oxyalkylene molecular structure hereinabove described. It has been found that from about 1 weight percent to about 15 weight percent of said low-foaming surfactant, based on the total weight of the composition, should be used to provide optimum cleansing and spotting and filming characteristics. A preferred amount of surfactant is from about 2 weight percent to about 10 weight percent of the composition.

While it is not essential, in addition to the essential components herein above described it may be desirable to incorporate an auxiliary foam-suppressor or defoaming agent in the dishwasher detergent compositions to provide an even further reduction in the foaming tendency of aqueous solutions thereof, particularly in the presence of proteinaceous food residues. Suitable auxiliary foam-suppressors include long chain fatty acids such as behenic acid (available commercially under the trade name "Hystrene 9022" from Humko Division, Witco Chemical Co) and alkyl phosphate esters containing 16 or more carbon atoms in the alkyl radical and, preferably, hexadecyl acid phosphate including the salts thereof. Other suitable foam-suppressors are well known and disclosed in the prior art.

In addition to the above ingredients it is understood that additional ingredients may be present, such as fillers, e.g., sucrose, sucrose esters, sodium chloride, sodium sulfate etc. in amounts from about 0.001% to about 60%; china protecting agents including aluminosilicates, aluminates, etc. in amounts from about 0.1% to about 5%; hydrotrope materials including sodium benzene, sodium toluene sulfonate, etc. in minor amounts; dyes; perfumes; crystal modifiers and the like can also be present in minor amounts.

The dishwasher detergent compositions of the invention may be formulated by known dry-blending or agglomeration techniques. In dry-blending, the pulverized components are merely mixed together, as by tumbling, to form the final product. In agglomeration, a specialized mixing technique is employed wherein, for example, the thoroughly commingled dry components are wetted in a controlled manner with the nonionic surfactant and silicate builder in solution form while the mass is thoroughly stirred. The resulting product is a free-flowing granular product.

EXAMPLES

The chemical designations used in the Examples are defined as follows, wherein 2-EH is 2-ethylhexyl, PO is oxypropylene and EO is oxyethylene.

| Designation | Description |
|---|---|
| Auxiliary Defoamant I | A mixture of arachidic and behenic fatty acids distributed under the tradename HYSTRENE 9022 by the Humko Division of the Witco Chemical Co. |
| Comparative Surfactant I | 2-EH 6PO/2PO.4EO, i.e., an oxyalkylene adduct of 2-ethyl hexanol having 6 moles of block oxypropylene and a random mixture of 2 and 4 moles of oxypropylene and oxyethylene respectively. |
| Comparative Surfactant II | 2-EH 13PO/8EO (Block) |
| Comparative Surfactant III | 2-EH 3PO/2PO.3EO |
| Comparative Surfactant IV | An oxyalkylene adduct of linear $C_{15}$ (average) primary alcohols having a random mixture of 5 and 7 moles of oxypropylene and oxyethylene respectively, distributed under the trade name PLURAFAC |

-continued

| Designation | Description |
|---|---|
| | RA-40 by BASF Wyandotte Corporation. |
| Comparative Surfactant V | A secondary alcohol alcoxylate, distributed under the trade name MIN FOAM 2X by Union Carbide Corporation. |
| Surfactant I | 2-EH 8PO/1PO.5EO |
| Surfactant II | 2-EH 9PO/2PO.6EO |
| Surfactant III | n-Octanol 8PO/1PO.4EO |

EXAMPLE 1

This Example illustrates a general procedure for producing the nonionic surfactant of the invention.

A 500-gallon reactor vessel with two rotating impellers, containing 8.3 lbs. of flaked potassium hydroxide catalyst, was charged with 495 lbs. of 2-ethylhexanol and the temperature raised to 115° C. using a nitrogen purge of the reactor vapor space at a pressure of 10 psig. Water was removed from the solution by sparging nitrogen through the liquid for four hours. Nitrogen, under a pressure of 5 psig, was put in the reactor and 1,931 lbs. of propylene oxide was added over nine hours. A maximum pressure of 37 psig was reached during the feed period and the pressure stabilized at 5 psig after a 1.5 hour reaction time. The reactor was vented and repressured at 5 psig, using nitrogen, subsequent to the reaction period.

Another 500-gallon reactor vessel was charged with 903.5 lbs. of ethylene oxide and 396.5 lbs. of propylene oxide and cooled to 5° to 10° C. with nitrogen at 5 psig pressure. The mixed oxide solution was fed into the reactor vessel containing the propylene oxide at a 5 psig pressure. The mixed oxide solution was fed into the reactor vessel containing the propylene oxide adduct of 2-ethylhexanol, over 8.5 hours with a maximum pressure of 45 psig being reached. The pressure stabilized at 23 psig during the following 2.5 hours. The reactor was then held at 115° C. under a pressure of 5 psig of nitrogen. The cloud point of the reaction mixture was 22.5° C.

The reaction mixture was then neutralized to a pH of 6.3 by adding 9.55 lbs. of acetic acid in three stages. The neutralized solution was stripped for four hours at 113°-115° C. After breaking vacuum with nitrogen, and cooling to 50° C., 3,564 lbs. of product were recovered through a filter having a 200 mesh screen. The product, Surfactant I, was an oxyalkylene adduct of 2-ethylhexanol having 9 mole of block oxypropylene and a random mixture of 2 and 6 moles of oxypropylene and oxyethylene respectively.

EXAMPLE 2

This Example compares the stability of various surfactants with active chlorine compounds such as those used in automatic dishwasher detergent compositions. The test procedure comprised placing the samples in an incubator for three weeks at around 370° C., and at a relative humidity of 80%. The chlorine content at the beginning and end of the tests was determined by iodometric titration. The samples consisted of 5 weight percent surfactant, 5 weight percent sodium dichlorisocyanurate, an active chlorine-containing compound, and 90% sodium tripolyphosphate, a detergency builder. The low-foaming nonionic surfactants of the present invention, identified as Surfactants I, II and III, are compared with other oxyalkylene adducts of alcohols having block oxypropylene groups and random mixtures of oxypropylene to oxyethylene, with a results indicated in Table 1.

TABLE 1

Chlorine Stability Tests

| Surfactant | Cloud Point, °C. | Chlorine Retention, % |
|---|---|---|
| Surfactant I | 20 | 15 |
| Surfactant II | 20 | 25 |
| Surfactant III | 20 | 32 |
| Comparative Surfactant I | 20 | 7 |
| Comparative Surfactant II | 25 | 12 |

The results show that the nonionic surfactants of the present invention yield unexpectedly superior results to surfactants having similar structures with regard to a block oxypropylene and random mixture of oxypropylene/oxyethylene structure, but which fall outside the scope of the present invention.

EXAMPLE 3

This Example demonstrates the low-foaming capability of the automatic dishwasher detergent compositions containing the nonionic surfactants of the present invention. The tests were conducted using test procedure CSMA Test DCC-01, well known to those skilled in the art. The rotor speed ratio is a measure of the defoaming tendency of the particular detergent, and is defined as the ratio of the impeller speed in an aqueous solution containing soil and the detergent composition, over the impeller speed in an aqueous solution only, times 100. A higher ratio percentage indicates superior low-foaming capacity. The nonionic surfactants of the present invention, identified as Surfactant I and II, were prepared using the general procedures set forth in Example 1 and compared with surfactants having similar structures to those of the present invention but falling outside the scope of the invention identified as Comparative Surfactants I and III. The results are given in Table 2 below.

TABLE 2

Defoaming Tests

| Surfactant | Cloud Point, °C. | Rotor Speed Ratio, % |
|---|---|---|
| Surfactant III | 20 | 49 |
| Surfactant II | 20 | 38 |
| Surfactant I | 20 | 26 |
| Comparative Surfactant I | 20 | 24 |
| Comparative Surfactant III | 21 | 4 |

The data indicate that nonionic surfactants of the present invention provide superior result to those surfactants having highly similar block oxypropylene and random mixture of oxypropylene/oxyethylene structures. A general trend is indicated in that a decrease in the block oxypropylene structure establishes a corresponding decrease in defoaming capacity. It should also be noted that Comparative Surfactant III has a structure highly similar to the nonionic surfactant disclosed in European Patent No. 19,173 as $C_9/C_{11}$ 2PO/2-PO.3EO.

EXAMPLE 4

This Example demonstrates the wetting capacity of the automatic dishwasher detergent compositions containing the nonionic surfactants of the present invention. The tests were conducted following the test procedure CSMA Test DCC-05, for detergent compositions containing 2% surfactant, 33% sodium silicate.$5H_2O$, 15% sodium carbonate, 28% sodium sulfate, 20% sodium tripolyphosphate and 2% sodium dichloroisocyanurate. The results, listed in Table 3 below, are based upon a rating scale as follows:

1=glass spotless
2=spots at random or barely perceptible film
3=¼ of glass covered with spots or film
4=½ of glass covered with spots or film
5=glass completely covered with spots or film

TABLE 3

| | Spotting and Filming Tests | | | |
|---|---|---|---|---|
| Cycle | Surfactant II | Surfactant III | Comparative Surfactant IV | Comparative Surfactant V |
| 1 | 2.0 | 2.6 | 2.0 | 2.0 |
| 2 | 2.3 | 2.2 | 2.1 | 2.0 |
| 3 | 2.0 | 2.4 | 2.5 | 2.6 |
| 4 | 2.0 | 2.5 | 2.5 | 2.6 |
| 5 | 2.4 | 2.5 | 4.0 | 2.6 |
| 6 | 2.1 | 2.2 | 3.6 | 2.5 |
| 7 | 2.0 | 2.9 | 3.6 | 2.2 |
| 8 | 2.4 | 3.2 | 3.7 | 2.4 |
| 9 | 2.8 | 3.4 | 3.9 | 2.6 |
| 10 | 2.8 | 3.5 | 4.0 | 2.6 |
| Average | 2.3 | 2.7 | 3.2 | 2.4 |

The data demonstrates that the automatic dishwasher detergent compositions containing the nonionic surfactants of the present invention provide wetting properties comparable and superior to commercially available nonionic surfactants.

EXAMPLE 5

This Example demonstrates the use as a preferred auxiliary defoamant, hexadecyl acid phosphate. The hexadecyl acid phosphate was produced by reacting 30.0 grams of hexadecyl alcohol with 100 milliliters of n-hexane by heating the reactants in the presence of polyphosphoric acid for six hours. Using similar test procedures as those described in Examples 2–4 above, an automatic dishwashing detergent containing Surfactant II with 4 percent hexadecyl acid phosphate as auxiliary defoamant, gave an average spotting and filming test value of 3.2, and a chlorine retention value of 21 percent. The defoaming efficiency was determined using varying levels of hexadecyl acid phosphate concentration as set forth in Table 4 below:

TABLE 4

| Defoaming Test | |
|---|---|
| Hexadecyl Acid Phosphate, Concentration, % | Rotor Speed Ratio, % |
| 0.0 | 41 |
| 1.5 | 58 |
| 3.0 | 73 |
| 5.0 | 75 |

I claim:

1. A method of washing dishes comprising washing them in a mechanical dishwasher with an aqueous solution comprising a nonionic surfactant having a cloud point of 20°–30° C. and having the formula:

$$R—O—A_x—B—H$$

wherein R is 2-ethylhexanol or n-octanol; A is an oxypropylene group; x is 8 or 9; and B is a random mixture of oxyethylene and oxypropylene groups with the molar ratio of oxyethylene to oxypropylene groups being about 3:1; in a dishwasher detergent exhibiting low-foaming, good wetting and scouring having a chlorine retention of at least 15 percent, and not needing an auxiliary foam suppressor.

* * * * *